United States Patent [19]

Weidl

[11] Patent Number: 4,798,033

[45] Date of Patent: Jan. 17, 1989

[54] ROOF EDGE ASSEMBLY

[75] Inventor: David Weidl, Columbus, Ohio

[73] Assignee: F. O. Schoedinger, Inc., Columbus, Ohio

[21] Appl. No.: 69,166

[22] Filed: Jul. 2, 1987

[51] Int. Cl.[4] ..... E04D 13/00

[52] U.S. Cl. ..... 52/94; 52/60

[58] Field of Search ..... 52/58–60, 52/94–97, 300, 573

[56] References Cited

U.S. PATENT DOCUMENTS

| | | | |
|---|---|---|---|
| Re. 26,056 | 7/1966 | Hickman | 52/94 |
| 1,910,605 | 5/1933 | Hansberry | 52/59 |
| 1,935,829 | 11/1933 | Bever | 52/60 |
| 2,596,786 | 5/1952 | Norrid | 52/94 |
| 3,719,010 | 3/1973 | Hickman | 52/60 |
| 3,766,694 | 10/1973 | Minialoff et al. | 52/95 |
| 3,862,531 | 1/1975 | Attaway et al. | 52/300 |
| 4,037,372 | 7/1977 | Patry | 52/96 |
| 4,071,987 | 2/1978 | Hickman | 52/94 |
| 4,241,549 | 12/1980 | Hall, III et al. | 52/60 |
| 4,403,458 | 9/1983 | Lolley | 52/60 |
| 4,404,777 | 9/1983 | Lolley et al. | 52/60 |
| 4,419,850 | 12/1983 | Butzen | 52/60 |
| 4,472,913 | 9/1984 | Hickman | 52/96 |
| 4,488,384 | 12/1984 | Hickman | 52/60 |
| 4,549,376 | 10/1985 | Hickman | 52/94 |
| 4,601,073 | 7/1986 | Methot | 4/506 |
| 4,641,476 | 2/1987 | Webb et al. | 52/60 |

FOREIGN PATENT DOCUMENTS

| | | | |
|---|---|---|---|
| 964026 | 3/1975 | Canada | 52/94 |
| 1347674 | 2/1974 | United Kingdom | 52/94 |

OTHER PUBLICATIONS

Robex Systems, Inc.; "FE Series Fascia and Water Dam", 2 pages.

MM Systems Corp.; "slf-series snap-lok fascia", pp. 4 and 5.

TRION Special Metals Division; "Snap-On Gravel Stop Fascias", RSI, Mar. 1987, 3 pages.

Carlisle SynTec Systems; "SecurEdge Gravel Stop", 2 pages.

Metal-Era, Inc.; "Fascia Systems 100, 200, 300", 7.36/Meu, (Sweets Catalog), 4 pages.

W. P. Hickman Company, Inc.; "Econosnap Roof Edge Systems", 7.36/Hi, (Sweets Catalog), 4 pages.

*Primary Examiner*—John E. Murtagh

*Assistant Examiner*—Andrew Joseph Rudy

*Attorney, Agent, or Firm*—Vorys, Sater, Seymour and Pease

[57] ABSTRACT

A roof edge assembly having a metal water dam adapted to be fastened at the edge of the roof to the nailer structure thereof to define a raised roof edge. The water dam has a lower horizontal dam portion positionable generally flush with the upper surface of the nailer structure and extending inwardly a distance past the nailer structure and onto the adjacent insulation and then bending onto itself to form an upper horizontal dam portion. Two thicknesses of metal thereby provided decrease the bowing at the mechanical securement points of the water dam. The water dam at the forward edge of the lower horizontal dam portion is bent downwardly for about a half an inch to define a tab portion which provides positive edge securement to the nailer making attachment and alignment thereof easier, and minimizing wind infiltration. A sloping portion of the water dam extends upwardly and outwardly from the upper horizontal dam portion and then bends to form a vertical dam portion extending in front of the tab portion and the nailer structure and past it. An outwardly sloping drip flange is formed at its lower end. An optional fascia or cover plate configured similar to the water dam can be fitted into place on the water dam. One embodiment of the cover plate has an inward horizontal portion for securing single-ply roofing membranes along the plane of the roof.

43 Claims, 2 Drawing Sheets

ROOF EDGE ASSEMBLY

BACKGROUND OF THE INVENTION

This invention relates to roof edging assemblies and more particularly to such assemblies used on the edges of buildings having flat roof decks or roofs with low rakes. These roofing edge assemblies are used to protect the edges of flat roof buildings and to provide a lip around the roof to contain water. During a rainstorm the sewers in cities are often overloaded by sudden increases of water running off roofs, sidewalks and the like, and so roof edge structures are now built to dam the water on the roofs and roof drains are provided which are capable of controlling the rate of flow off of the roof. The drains limit the quantity of water which the sewers must handle during the storm and then permit the dammed water to flow off the roofs after the rain has stopped. These edging systems also control against the spill off of water at the edge of the roof deck and thence downwardly along the outside wall of the building.

The roof edge assemblies can secure the edges of the roof rubber sheet membranes to the edges of the roof and also restrain the ballast such as gravel provided on the rubber sheet membrane. Fascia or cover plates have been used to attach on to and protect the underlying water dams, and, also to provide an aesthetically appealing finishing trim. The roof edging structures can also act as a moisture seal at the outer edges of the building where the built-up deck ends are to prevent moisture from seeping in under the roof. Examples of prior roof edging systems are shown for example in U.S. Pat. Nos. 3,719,010, 4,071,987, 4,488,384, and U.S. Pat. No. Re. 26,056, the disclosures of each of which are hereby incorporated by reference in their entirety.

Problems have been experienced with prior roof edging systems though. Many of them are difficult to install and particularly to align them relative to the edge of the roof. Bowing has been experienced at the points of the mechanical securement thereof to the underlying nailer structure. Gaps have been experienced between the nailer and the laterally adjacent insulation and shifting of the insulation has been a problem in the past. Wind uplifting forces at the face of the assembly have caused the cover plate thereof to lift up and the roofing membrane sheet to flutter. Accordingly, a need has arisen for an improved design for roof edging assemblies.

OBJECTS OF THE INVENTION

Accordingly, it is the principal object of the present invention to provide an improved design of a roof edging assembly.

Another object of the present invention is to provide an improved configuration of the water dam portion of a roof edging assembly.

A further object of the present invention to provide an improved design for a roof edging assembly which is easier to install and to align on the roof edge.

A still further object of the present invention to provide an improved water dam configuration which minimizes shifting or thermal movement of the insulation boards relative to the adjacent nailer structure.

Another object of the present invention is to provide an improved metal dam construction design which decreases the bowing experienced with many prior systems at the mechanical securement thereof to the underlying nailer structure.

A further object of the present invention is to provide an improved metal roof edging assembly which minimizes the wind infiltration at the base thereof and minimizes any wind uplifting forces on the overlying cover plate or fascia and the flutter of the roofing membrane sheet.

Other objects and advantages of the present invention will become more apparent to those persons skilled in the art from the foregoing description taken into conjunction with the accompanying drawings.

DETAILED DESCRIPTION OF THE PREFERRED EMBODIMENTS

Figure 1:
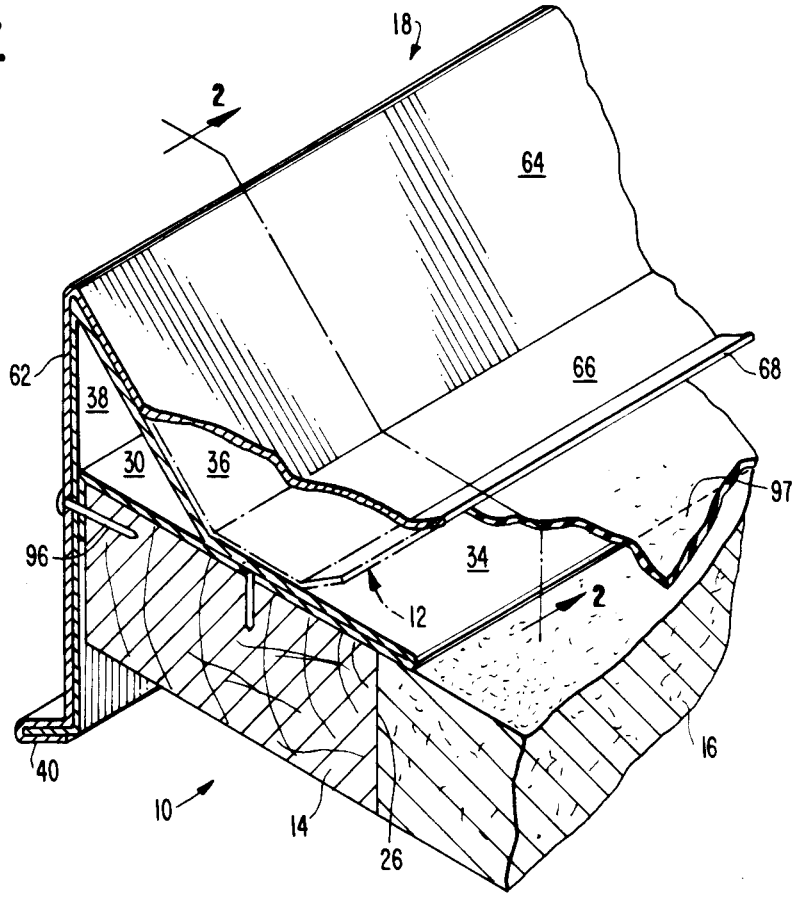
FIG. 1 is a fragmentary outward perspective view of a first embodiment of a roof edging assembly of the present invention with parts thereof broken away for the sake of clarity.
Figure 2:
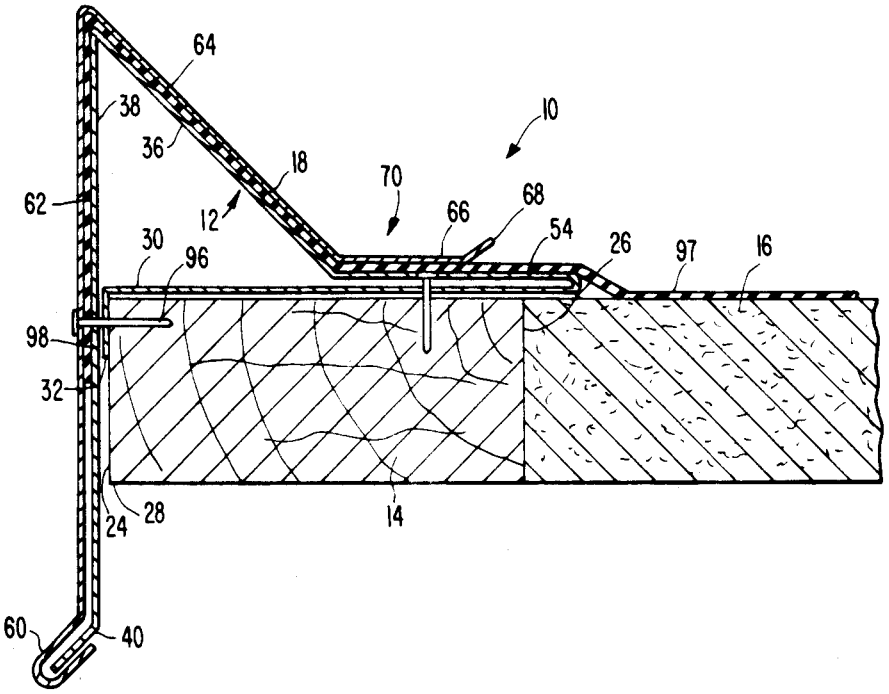
FIG. 2 is a cross-sectional view of the roof edging assembly of FIG. 1 taken along line 2—2 thereof.

A first embodiment of a roof edging assembly of the present invention is illustrated in FIGS. 1 and 2 generally at 10. Roof edging assembly 10 basically comprises a water dam shown generally at 12 secured to the wood nailer structure 14 of the edge of the roof and overlying the layer of insulation 16 positioned directly laterally inward from the nailer structure. An optional fascia or cover plate as shown generally at 18 can be fitted on top of the water dam 12.

The water dam 12 has a unique configuration which remedies many of the above-mentioned problems experienced with prior designs, and this configuration will be described in its positioning and attachment relative to the nailer structure 14. For ease of explanation it is seen that the nailer structure 14 has a nailer forward edge 20, a nailer upper surface 22, a nailer front surface 24, a nailer rear edge 26, and a nailer bottom edge 28. The water dam 12 has a lower horizontal dam portion 30 extending inwardly relative to the building roof, from the nailer forward edge 20 and generally flush with the upper nailer surface 22. A tab portion 32 extends from the forward end of the lower horizontal dam portion 30 downwardly generally along the nailer front surface 24, and provides a seal area along the base dam face wind surface thereby minimizing infiltration of the wind and reducing any uplifting forces caused by the wind on the cover plate 18 and also reducing membrane sheet flutter associated with mechanically attached and/or loose laid single ply systems. At its inward end the lower horizontal dam portion 30 extends onto the insulation 16 and is bent or formed onto itself to form an upper horizontal dam portion 34 extending generally parallel and adjacent to the lower horizontal dam portion 30 and extending outwardly relative to the roof.

This provides a transition zone between the wood nailer structure 14 and the insulation 16 thereby decreasing the area for gaps in between them, and increases the hold-down area around the perimeter of the insulation boards 16 minimizing shifting thereof. The two thicknesses of metal (30, 34) at the dam base decrease the bowing at the mechanical securement of the water dam 12 to the underlying nailer structure 14.

The water dam 12 is bent or formed upwardly relative to a central location of the nailer structure 14 and forms a cant or sloping dam portion 36 defining a raised edge for holding the rain water on the roof and preventing water spill over. At a location generally above the tab portion 32 the water dam 12 is bent or formed downwardly to define a vertical dam portion 38 which extends downwardly and immediately outside of the tab portion 32 and generally along the nailer front surface 24. The vertical dam portion 38 extends down a distance below the nailer bottom edge 28 and at the lower edge thereof is bent or formed downwardly and outwardly to form a drip flange 40 for guiding any water thereon away from the building. The water dam 12 can be formed in a single piece construction of a G-90 galvanized twenty-six gauge metal which is bent or formed into its various connected positions. Five separate operations with a knife die on the top and a narrow bottom die are used to form the water dam with the most difficult of these operations being the flattening of the doubled-over section so that the one-half inch lip part forms flush with the face on the inside.

Figure 5:
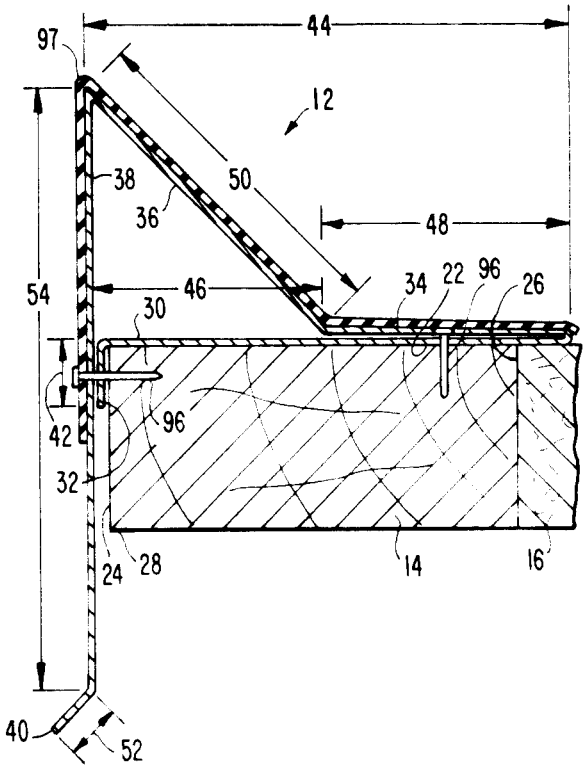
FIG. 5 is a cross-sectional view similar to FIGS. 2 and 4 illustrating the water dam of the roof edging assemblies of FIGS. 1 and 3 with component preferred dimensions noted, and the positioning thereon and securing thereto of the roofing membrane shown.

Although the precise and relative sizings of each of the portions of the water dam 12 can be varied to accommodate different needs and situations, a preferred dimensioning is best illustrated in FIG. 5. Referring thereto it is seen that the tab portion at 32 has a length of one-half inch as shown by distance 42, the total inward distance of the water dam 12 is illustrated at 44 which is generally four inches. This is divided generally into equal parts at the bend or start of the sloping dam portion 36, i.e., the distances represented by 46 and 48 are each about two inches. The sloping dam portion 36 has a length as illustrated at 50 of two and seven eighths inches, the lower drip flange 40 has a length of one-half inch as depicted at 52, and the total length of the vertical dam portion 38 as designated by numeral 54 is about five inches.

The cover plate 18 is configured and adapted to fit onto the water dam 12, and can be formed of twenty-four gauge galvanized metal. It is anticipated that the standard color thereof will be dark brown but optional colors to suit any architectural needs should be provided. A strippable film thereon protects the surface of the cover plate 18 during shipping and installation. As depicted in FIGS. 1 and 2 the cover plate 18 has an upwardly and inwardly disposed channel 60 at its lower front end into which the drip flange 40 is received in a tongue-and-groove type of relationship. The cover plate 18 further has a vertical face plate portion 62 extending up from the channel 60 along the vertical dam portion 38 and is bent at its upper end at generally the same angle as the adjacent water dam 12 to form a sloping plate portion 64 generally parallel to the sloping dam portion 36 and extending until it is immediately above the upper horizontal dam portion 34. It bends there to form a horizontal plate portion 66 which extends inwardly for about an inch or an inch and a half where it bends upwardly and inwardly to define an inner plate lip 68. Thus as is best shown in FIG. 2 a trough shown generally at 70 is thereby formed.

Figure 3:
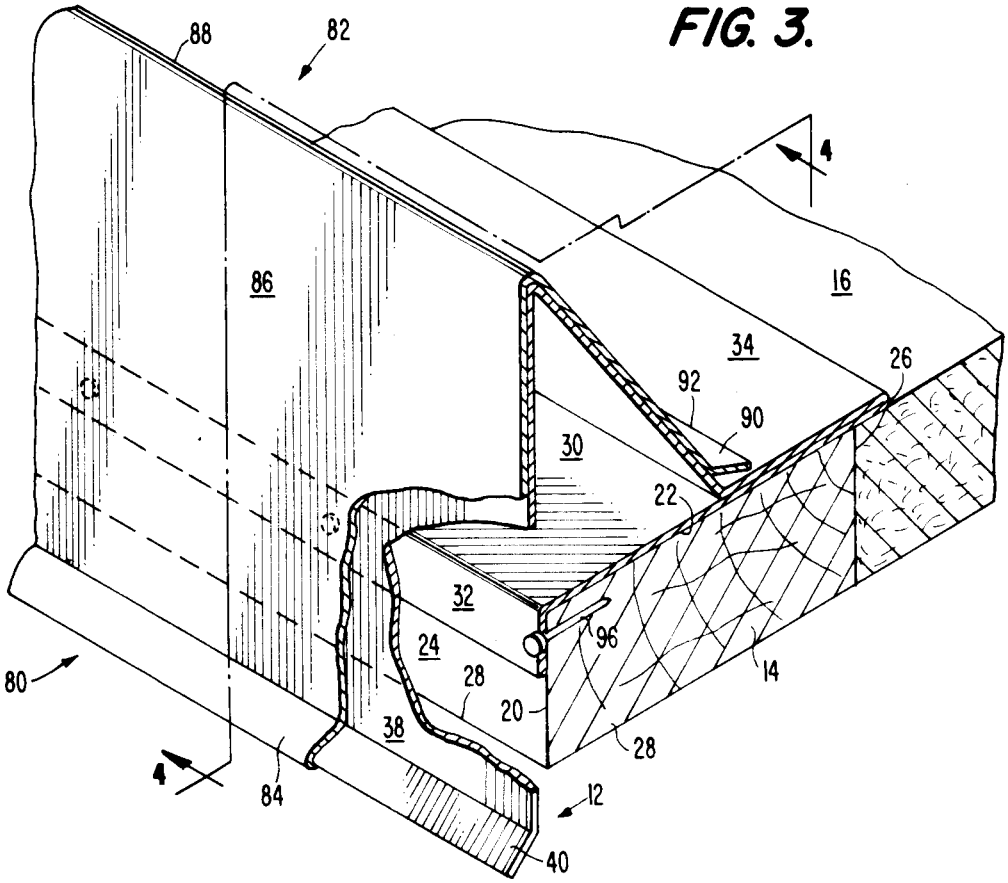
FIG. 3 is a fragmentary inward perspective view of a second embodiment of a roof edging assembly of the present invention with parts thereof broken away for the sake of clarity.
Figure 4:
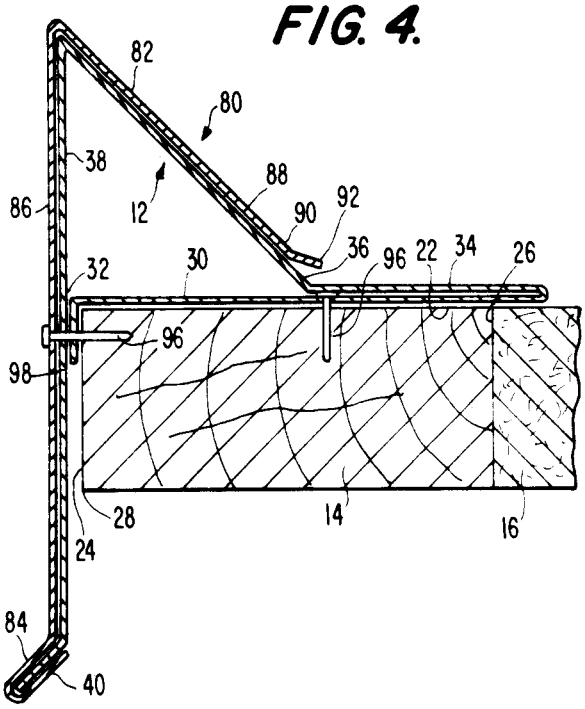
FIG. 4 is a cross-sectional view of the roof edging assembly of FIG. 3 taken along line 4—4 thereof.

A second embodiment of the roof edging assembly of the present invention is illustrated generally at 80 in FIGS. 3 and 4. Referring thereto it is seen that the water dam 12 thereof has the same configuration as the water dam 12 of roof edging assembly 10 and therefore like parts will be referred to with like reference numerals. The optional cover plate 82 of roof edging assembly 80 also has a lower upwardly and inwardly disposed channel 84 and a vertical plate portion 86, but its sloping plate portion 88 is slightly different than that of the sloping plate portion 88 of the embodiment FIGS. 1 and 2. More particularly its lower end 90 is disposed a quarter or a half inch above the plane of the upper horizontal dam portion 34 at a slight distance outwardly from the juncture of the upper horizontal dam portion 34 and the sloping dam portion 36. At this end the cover plate 82 is bent or formed to define a narrow lip 92 extending inwardly and downwardly but at an angle which is shallower than the angle of descent of the sloping plate portion 64. The lip 92 allows the roofing membrane (discussed in detail below) to flex when it expands and contracts thereby minimizing the possibility that the membrane will be cut or torn by the metal edge of the sloping plate portion 88. It is anticipated that the cover plate 82 will be the cover plate design used for most roof edge constructions, and that the cover plate 18 will particularly be used with single-ply membranes which require the positive securement by the horizontal plate portion 66 along the plane of the roof.

The installation of either of the roofing edge assemblies 10 or 80 of the present invention is relatively easy and straightforward. The ten foot sections of the water dam 12 are installed on the roof nailer structure 14 allowing one eighth of an inch between them for expansion. Approved fasteners such as galvanized roofing nails 96 are installed preferably through preformed or prepunched openings in the water dam 12 at twelve inch on centers securing the water dam 12 to the underlying nailer structure 14 both through the tab portion 32 and through the double thickness dam portion through the upper and lower horizontal dam portions 30, 34. The roofing membrane, as best shown in FIG. 5 at 97, is positioned over the water dam 12 and fastened to the sloping dam portion 36 of the dam and into the wood nailer structure 14 at twelve inch on center maximum. The roofing edge assemblies 10 and 80 can be used with most single-ply roofing membranes including EPDM, PIB, CPE, modified bitumen, and PVC. The cover plates 18 or 82 are positioned by sliding on the water dam 12 and membrane 97 and pressing down with a rubber mallet or the palm of a hand so that the flange and channel engage; it thereby snaps permanently locked into position. Approximately one eighth of an inch is allowed for expansion between adjacent sections of the cover plates 18, 82. Inside and outside mitered corners, overflow scuppers, and spillouts, none of which are illustrated herein, are installed next. A bead of caulking (fed. spec. II-S-00230 C, type 2) as shown at 98 can be installed between the tab portion 32 and the vertical plate portion 62, 86 to minimize wind infiltration therebetween.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely by the claims appended hereto.

What is claimed is:

1. An assembly for forming a raised roof edge on a building structure, the building structure having a horizontal or gently sloping roof, and a nailer structure secured to the edge of the roof, the nailer structure having a nailer forward edge, a nailer upper surface, a nailer front surface, a nailer rear edge, and a nailer bottom edge, said assembly comprising:

a water dam, said water dam including a lower horizontal dam portion having a forward end and a rear end and adapted to extend inwardly from the nailer forward edge, a tab portion extending from said forward end of said lower horizontal dam portion and adapted to extend downwardly generally along the nailer front surface, an upper horizontal dam portion extending from said rear end of said lower horizontal dam portion and adapted to extend outwardly towards the nailer forward edge, a sloping dam portion extending upwardly and outwardly from said upper horizontal dam portion and adapted to extend above the nailer upper surface and towards the plane of the nailer front surface, and a generally vertical dam portion extending downwardly from said sloping dam portion and outside of said tab portion, and adapted to extend downwardly past the nailer upper surface and generally along the nailer front surface; and a cover plate fitted onto said water dam, said cover plate including an inwardly and downwardly sloping plate portion having a top and a lower end and generally fitting on said sloping dam portion, and a generally vertical face plate portion extending downwardly from said top of said sloping plate portion and directly outside of said vertical dam portion, said sloping plate portion extending down to be immediately above said sloping dam portion, and a horizontal plate portion extending inwardly from said lower end of said sloping plate portion.

2. The assembly of claim 1 including, said upper horizontal dam portion having an inward edge, and said horizontal plate portion having the inward edge thereof spaced outwards a distance from said inward edge of said upper horizontal dam portion.

3. The assembly of claim 1 including, said horizontal plate portion having an inward end, and said cover plate including an inwardly and upwardly extending plate lip at said inward end of said horizontal plate portion.

4. The assembly of claim 1 including, said vertical plate portion having a lower end, said cover plate including at said lower end of said vertical plate portion an inwardly and upwardly formed channel, said vertical dam portion having a lower end, said water dam including a downwardly and outwardly extending tongue portion of said lower end of said vertical dam portion, and said tongue portion being received in said channel.

5. The assembly of claim 1 including, said vertical face plate portion having an uppermost top end, and said top of said sloping plate portion and said top end of said vertical face plate portion being directly joined together so that said vertical face plate and said sloping plate portions define an acute angle therebetween.

6. The assembly of claim 1 further comprising, a single-ply roofing membrane sandwiched between said horizontal plate portion and said upper horizontal dam portion.

7. The assembly of claim 6 including, said vertical dam portion having a front face, and said membrane being disposed against said front face.

8. The assembly of claim 7 including, a mechanical fastening means for mechanically fastening said membrane to said front face.

9. The assembly of claim 8 including, said fastening means comprising at least one nail.

10. The assembly of claim 6 including, said membrane being EPDM.

11. The assembly of claim 1 including, said sloping dam portion having an uppermost top edge, said vertical dam portion having an uppermost top edge, and top edges of said sloping and vertical dam portions directly joining each other at a juncture so that said sloping and vertical dam portions define an acute angle therebetween.

12. The assembly of claim 1 including, said water dam being formed of a G-90 galvanized twenty-six gauge metal.

13. An assembly for forming a raised roof edge on a building structure having a horizontal or gently sloping roof, a single-ply roofing membrane, and a nailer structure secured to the edge of the roof, the nailer structure having a nailer forward edge, a nailer upper surface, a nailer front surface, a nailer rear edge, and a nailer bottom edge, said assembly comprising:

a water dam including:

a lower horizontal dam portion having a forward end and a rearward end and adapted to extend inwardly from the nailer forward edge;

a tab portion extending from said forward end of said lower horizontal dam portion and adapted to extend downwardly generally along the nailer front surface;

an upper horizontal dam portion extending from said rear end of said lower horizontal dam portion and adapted to extend outwardly towards the nailer forward edge;

a sloping dam portion extending upwardly and outwardly from said upper horizontal dam portion and adapted to extend above the nailer upper surface and towards the plane of the nailer front surface, said sloping dam portion having an uppermost top edge;

a generally vertical dam portion extending downwardly from said sloping dam portion and outside of said tab portion, and adapted to extend downwardly past the nailer upper surface and generally along the nailer front surface, said vertical dam portion having an uppermost top edge; and top edges of said sloping and vertical dam portions directly joining each other at a juncture so that said sloping and vertical dam portions define an acute angle therebetween said sloping and vertical dam portions being formed of a single piece of metal bent to define said juncture.

14. The assembly of claim 13 including, said water dam being formed of a G-90 galvanized twenty-six gauge metal.

15. The assembly of claim 13 including, said lower horizontal dam portion being wide enough to extend inwardly past the nailer rear edge when said water dam is secured to the nailer structure.

16. The assembly of claim 13 including, said vertical dam portion having an outer face and a plurality of preformed mechanical-fastener openings therethrough spaced along the length of said vertical dam portion and directly adjacent to said tab portion such that, when the single-ply roofing membrane is disposed along said outer face, mechanical-fasteners can be inserted through the membrane, said preformed mechanical-fastener openings and said tab portion and into the nailer front surface.

17. For a horizontal or gently sloping roof having a roof edge, a raised roof edge assembly comprising: a nailer structure secured to the roof edge, the nailer structure having a nailer forward edge, a nailer upper surface, a nailer rear edge, and a nailer bottom edge; and a single-ply membrane positioned generally above the nailer structure, wherein the improvement comprises:

a water dam, said water dam including a lower horizontal dam portion extending inwardly from the nailer forward edge and having a forward end and a rear end, a tab portion extending from said forward end of said lower horizontal dam portion and extending downwardly generally along the nailer front surface, an upper horizontal dam portion extending from said rear end of said lower horizontal dam portion and outwardly towards the nailer forward edge, a sloping dam portion extending upwardly and outwardly from said upper horizontal dam portion and extending above the nailer upper surface and towards the plane of the nailer front surface, and a generally vertical dam portion extending downwardly from said sloping dam portion and outside of said tab portion, and extending downwardly past the nailer upper surface and generally along the nailer front surface; and a mechanical fastener fastening the single-ply membrane directly to said vertical dam portion.

18. The assembly of claim 17 including, said water dam being formed of a G-90 galvanized twenty-six gauge metal.

19. The assembly of claim 17 including, said upper and lower horizontal dam portions being formed from a single piece of material and folded onto one another such that said upper horizontal dam portion is directly above and parallel to said lower horizontal dam portion.

20. The assembly of claim 17 including, said vertical dam portion extending below the nailer bottom edge.

21. The assembly of claim 20 including, said vertical dam portion having a lower end, and said water dam including a downwardly and outwardly extending drip flange portion at said lower end of said vertical dam portion.

22. The assembly of claim 21 including, said upper and lower horizontal dam portions, said sloping and vertical dam portions, and said tab and flange portions, all being formed in a one-piece metal construction.

23. The assembly of claim 17 including, said lower horizontal dam portion extending inwardly past the nailer rear edge.

24. The assembly of claim 23 including, said lower horizontal dam portion extending inwardly by at least one half inch beyond the nailer rear edge.

25. The assembly of claim 17 including, said tab portion being vertically one-half inch long.

26. The assembly of claim 17 further comprising, a cover plate fitted onto said water dam.

27. The assembly of claim 26 including, said cover plate including an inwardly and downwardly sloping plate portion having a top and fitting on said sloping dam portion, and a generally vertical face plate portion extending downwardly from said top of said sloping plate portion and directly outside of said vertical dam portion.

28. The assembly of claim 27 including, said vertical face plate portion having a top end, and said top of said sloping plate portion and said top end of said vertical face plate portion being directly joined together so that said vertical face plate and said sloping plate portions define an acute angle.

29. The assembly of claim 27 including, said sloping dam portion having a lower edge, said sloping plate portion having a lower end, and said lower end being spaced a distance greater than one quarter inch above said lower edge of said sloping dam portion.

30. The assembly of claim 29 including, said cover plate including a ramp plate portion extending inwardly and downwardly from, and at a shallower angle than, said lower end of said sloping plate portion towards said upper horizontal dam portion.

31. The assembly of claim 30 including, said sloping plate portion having a lower free end, and said lower free end being spaced above said upper horizontal dam portion.

32. The assembly of claim 27 including, said sloping plate portion extending down to be immediately above said upper plate portion, and said cover plate including a horizontal plate portion extending inwardly from said lower end of said sloping plate portion.

33. The assembly of claim 32 including, said upper horizontal dam portion having an inward edge, said horizontal plate portion having an inward edge, and said inward edge of said horizontal plate portion being spaced outwards a distance from said inward edge of said upper horizontal dam portion.

34. The assembly of claim 32 including, said horizontal plate portion having an inward end, and said cover plate including an inwardly and upwardly extending plate lip at said inward end of said horizontal plate portion.

35. The assembly of claim 27 including, said vertical plate portion having a lower end, said cover plate including at said lower end of said vertical plate portion an inwardly and upwardly formed channel, said vertical dam portion having a lower end, said water dam including a downwardly and outwardly extending tongue portion at said lower end of said vertical dam portion, and said tongue portion being received in said channel.

36. The assembly of claim 27 including, a bead of caulking compound positioned directly between said vertical tab portion and said face plate portion.

37. The assembly of claim 17 including, said mechanical fastener comprising a nail.

38. The assembly of claim 17 including, said water dam including preformed openings therethrough through which said mechanical fastener passes.

39. The assembly of claim 38 including, said preformed openings passing through said vertical dam portion.

40. The assembly of claim 17 further comprising, roofing insulation structure positioned directly and laterally inward of the nailer structure.

41. The assembly of claim 40 including, said lower dam portion extending inwardly a distance beyond the nailer rear edge and onto the roofing insulation structure.

42. The assembly of claim 41 including, said distance being at least one half inch.

43. The assembly of claim 17 including, said sloping dam portion having a top edge, said vertical dam portion having a top edge, and top edges of said sloping and vertical dam portions directly joining each other at a juncture so that said sloping and vertical dam portions define an acute angle therebetween.

* * * * *